US006196017B1

(12) United States Patent
Chapman

(10) Patent No.: US 6,196,017 B1
(45) Date of Patent: Mar. 6, 2001

(54) COOLING INSERT

(76) Inventor: David H. Chapman, Smugglers Barn, Snow Hill, Crawley Down, Sussex RH10 3EF (GB)

( * ) Notice: Subject to any disclaimer, the term of this patent is extended or adjusted under 35 U.S.C. 154(b) by 0 days.

(21) Appl. No.: 09/353,961

(22) Filed: Jul. 15, 1999

(51) Int. Cl.[7] ..... F25D 3/08
(52) U.S. Cl. ..... 62/372; 62/457.8; 62/529
(58) Field of Search ..... 62/457.2, 457.3, 62/457.4, 457.5, 457.6, 457.7, 457.8, 529, 371, 372

(56) References Cited

U.S. PATENT DOCUMENTS 1,130,932 * 3/1915 Rumpel ..... 62/371
1,952,026 * 3/1934 Bennett ..... 62/371
2,034,478 * 3/1936 Levy ..... 62/457.6
2,216,202 * 10/1940 Lake ..... 62/371
4,255,944 * 3/1981 Gardner et al. ..... 62/457.8
4,306,424 * 12/1981 Chavoor ..... 62/371
4,393,665 * 7/1983 Gardner et al. ..... 62/457.8

* cited by examiner

*Primary Examiner*—William E. Tapolcai

(57) ABSTRACT

A cooling insert for insertion into a wine bottle cooler for cooling a bottle of wine therein. The cooling insert includes a housing for holding a cooling material therein and which includes a bottom wall, a perimeter side wall upwardly extending around the bottom wall of the housing, and an open top defined by a top edge of the perimeter side wall of the housing. A lid is inserted into the open top of the housing. The lid has a plurality of holes therethrough. The perimeter side wall of the housing has an inner surface with a shoulder therearound adjacent the top edge of the perimeter side wall of the housing. The lid rests on the shoulder of the perimeter side wall.

10 Claims, 2 Drawing Sheets

COOLING INSERT

BACKGROUND OF THE INVENTION

1. Field of the Invention

The present invention relates to beverage container cooling devices and more particularly pertains to a new cooling insert for insertion into a wine bottle cooler for cooling a bottle of wine therein.

2. Description of the Prior Art

The use of beverage container cooling devices is known in the prior art. More specifically, beverage container cooling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,212,963; U.S. Pat. No. 4,019,340; U.S. Pat. No. 2,767,563; U.S. Pat. No. 3,757,852; U.S. Pat. No. 3,089,317; and U.S. Pat. No. Des. 367,589.

While these devices fulfill their respective, particular objectives and requirements, the aforementioned patents do not disclose a new cooling insert. The inventive device includes a housing for holding a cooling material therein and which includes a bottom wall, a perimeter side wall upwardly extending around the bottom wall of the housing, and an open top defined by a top edge of the perimeter side wall of the housing. A lid is inserted into the open top of the housing. The lid has a plurality of holes therethrough. The perimeter side wall of the housing has an inner surface with a shoulder therearound adjacent the top edge of the perimeter side wall of the housing. The lid rests on the shoulder of the perimeter side wall.

In these respects, the cooling insert according to the present invention substantially departs from the conventional concepts and designs of the prior art, and in so doing provides an apparatus primarily developed for the purpose of insertion into a wine bottle cooler for cooling a bottle of wine therein.

SUMMARY OF THE INVENTION

In view of the foregoing disadvantages inherent in the known types of beverage container cooling devices now present in the prior art, the present invention provides a new cooling insert construction wherein the same can be utilized for insertion into a wine bottle cooler for cooling a bottle of wine therein.

The general purpose of the present invention, which will be described subsequently in greater detail, is to provide a new cooling insert apparatus and method which has many of the advantages of the beverage container cooling devices mentioned heretofore and many novel features that result in a new cooling insert which is not anticipated, rendered obvious, suggested, or even implied by any of the prior art beverage container cooling devices, either alone or in any combination thereof.

To attain this, the present invention generally comprises a housing for holding a cooling material therein and which includes a bottom wall, a perimeter side wall upwardly extending around the bottom wall of the housing, and an open top defined by a top edge of the perimeter side wall of the housing. A lid is inserted into the open top of the housing. The lid has a plurality of holes therethrough. The perimeter side wall of the housing has an inner surface with a shoulder therearound adjacent the top edge of the perimeter side wall of the housing. The lid rests on the shoulder of the perimeter side wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cooling insert apparatus and method which has many of the advantages of the beverage container cooling devices mentioned heretofore and many novel features that result in a new cooling insert which is not anticipated, rendered obvious, suggested, or even implied by any of the prior art beverage container cooling devices, either alone or in any combination thereof.

It is another object of the present invention to provide a new cooling insert which may be easily and efficiently manufactured and marketed.

It is a further object of the present invention to provide a new cooling insert which is of a durable and reliable construction.

An even further object of the present invention is to provide a new cooling insert which is susceptible of a low cost of manufacture with regard to both materials and labor, and which accordingly is then susceptible of low prices of sale to the consuming public, thereby making such cooling insert economically available to the buying public.

Still yet another object of the present invention is to provide a new cooling insert which provides in the apparatuses and methods of the prior art some of the advantages thereof, while simultaneously overcoming some of the disadvantages normally associated therewith.

Still another object of the present invention is to provide a new cooling insert for insertion into a wine bottle cooler for cooling a bottle of wine therein.

Yet another object of the present invention is to provide a new cooling insert which includes a housing for holding a cooling material therein and which includes a bottom wall, a perimeter side wall upwardly extending around the bottom wall of the housing, and an open top defined by a top edge of the perimeter side wall of the housing. A lid is inserted into the open top of the housing. The lid has a plurality of holes therethrough. The perimeter side wall of the housing has an inner surface with a shoulder therearound adjacent the top edge of the perimeter side wall of the housing. The lid rests on the shoulder of the perimeter side wall.

Still yet another object of the present invention is to provide a new cooling insert that is easy to remove from a wine bottle cooler for easy replacement and cleaning thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
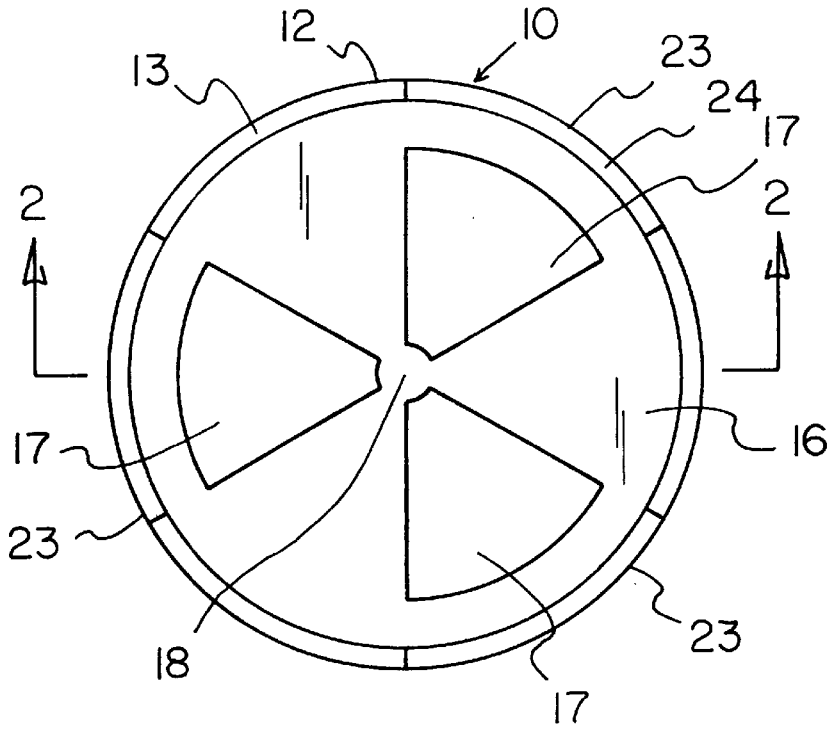
FIG. 1 is a schematic top view of a new cooling insert according to the present invention.
Figure 2:
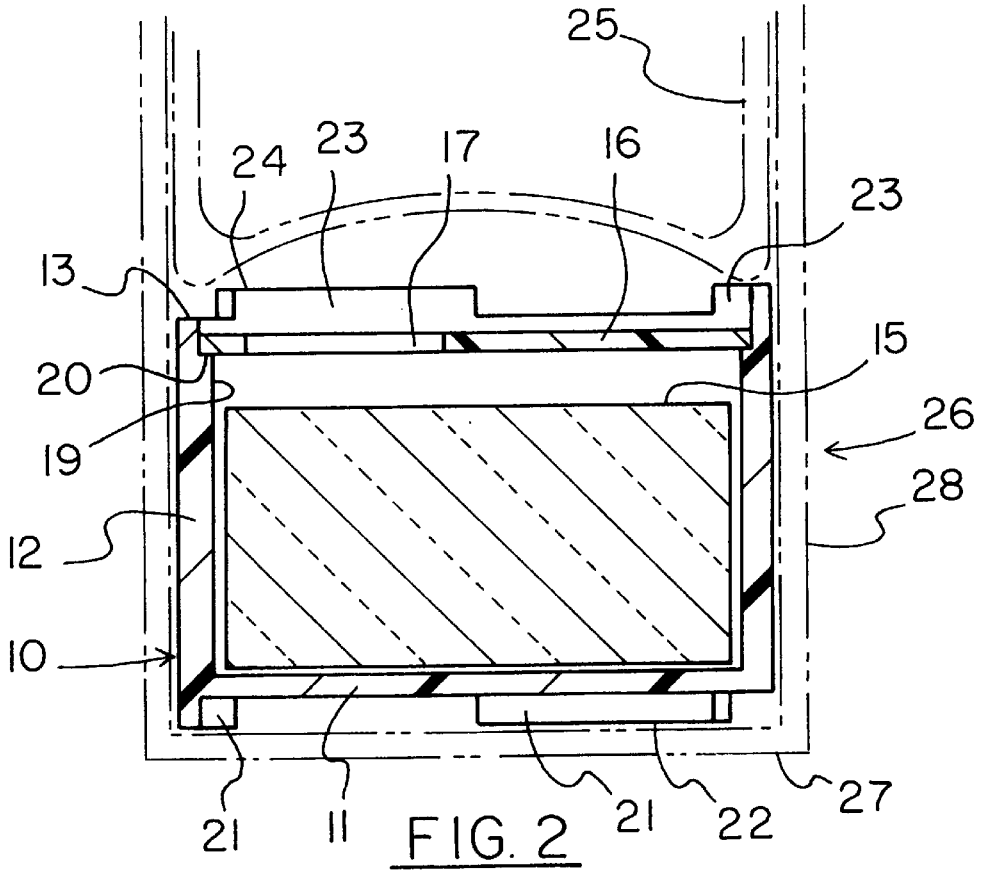
FIG. 2 is a schematic cross sectional view taken from line 2—2 of FIG. 1 and illustrating the cooling insert in use.
Figure 3:
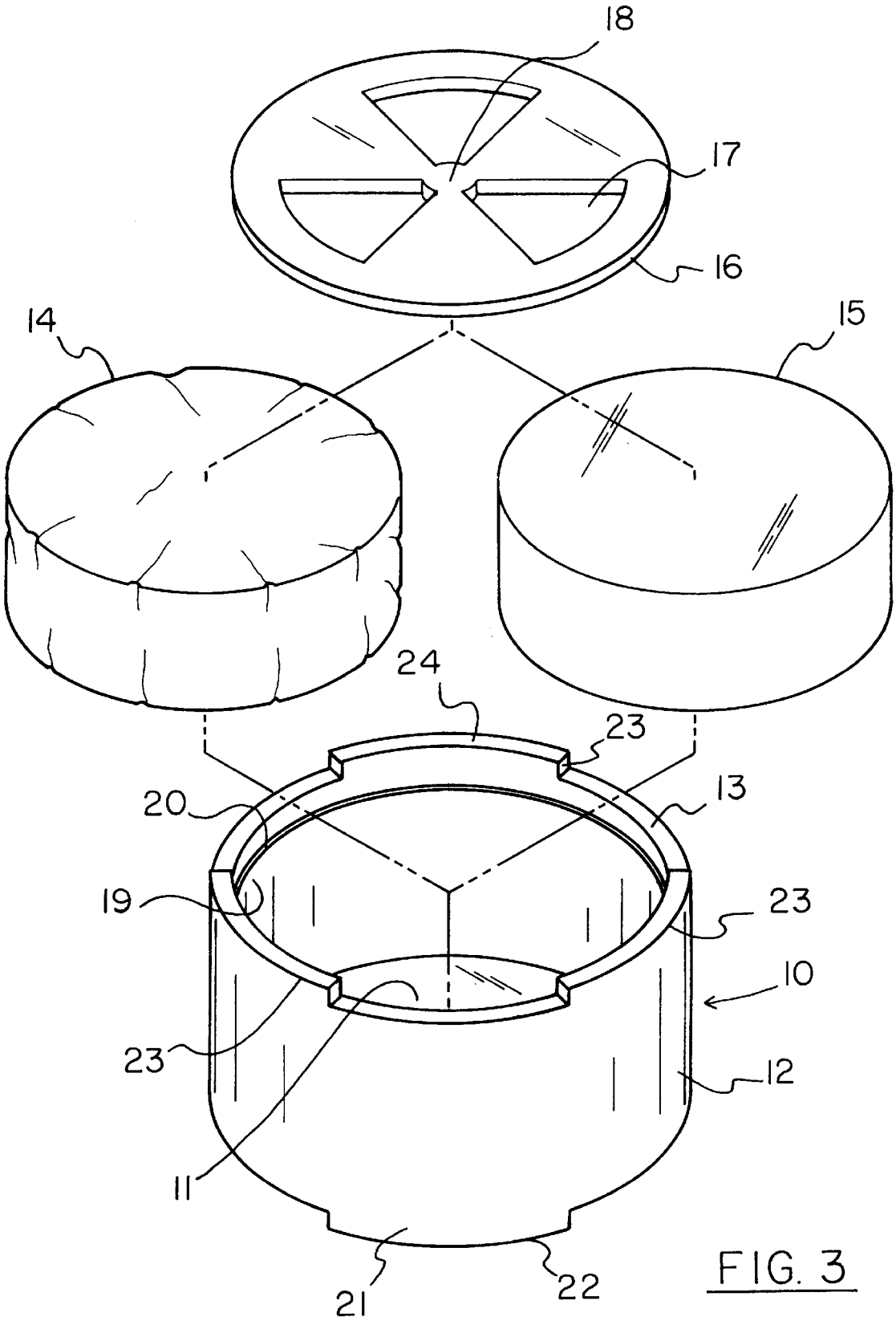
FIG. 3 is a schematic exploded perspective view of the present invention with two possible embodiments of the cooling material.

With reference now to the drawings, and in particular to FIGS. 1 through 3 thereof, a new cooling insert embodying the principles and concepts of the present invention will be described.

As best illustrated in FIGS. 1 through 3, the cooling insert generally comprises a housing for holding a cooling material therein and which includes a bottom wall, a perimeter side wall upwardly extending around the bottom wall of the housing, and an open top defined by a top edge of the perimeter side wall of the housing. A lid is inserted into the open top of the housing. The lid has a plurality of holes therethrough. The perimeter side wall of the housing has an inner surface with a shoulder therearound adjacent the top edge of the perimeter side wall of the housing. The lid rests on the shoulder of the perimeter side wall.

In closer detail, a cooling insert includes a housing 10 designed for holding a cooling material therein and which may have a generally cylindrical configuration. The housing includes a generally circular bottom wall 11, a generally cylindrical perimeter side wall 12 upwardly extending around the bottom wall of the housing, and an open top defined by a generally circular top edge 13 of the perimeter side wall of the housing. The housing may comprise a plastic material. In an illustrative embodiment, the housing may have a height defined between the top edge of the perimeter side wall and the bottom wall of about 2 inches, and an outer diameter defined across the perimeter side wall of about 3 inches.

A cooling material is disposed in the housing. In a first embodiment, the cooling material may comprise a generally disk-shaped freezable gel cooling pack 14 with a freezable gel enclosed therein. In a second embodiment, the cooling material may comprise a generally disk-shaped block of ice 15. In a third embodiment, the cooling material may simply comprise a volume of crushed ice.

The cooling insert also includes a lid 16 which may be generally circular in shape and has substantially planar top and bottom faces, and a generally circular outer perimeter. Like the housing, the lid may also comprise a plastic material.

The lid has a plurality of generally triangular wedge-shaped air holes 17 extending therethrough between the top and bottom faces of the lid. In one embodiment, the holes of the lid may be arranged on the lid to outwardly radiating from a center of the lid such that a generally circular extent 18 is defined on the lid between the holes of the lid at the center of the lid.

The lid is inserted into the open top of the housing to generally cover the cooling insert in the housing. The perimeter side wall of the housing has an inner surface 19 with an upwardly facing annular shoulder 20 therearound adjacent the top edge of the perimeter side wall of the housing.

In one embodiment, the annular shoulder of the perimeter side wall lies in plane substantially parallel to the bottom wall of the housing and positioned above the cooling insert in the housing. The bottom face of the lid rests on the annular shoulder of the perimeter side wall such that the lid lies in a plane substantially parallel with the bottom wall of the housing.

The outer perimeter of the lid may also frictionally engage the inner surface of the perimeter side wall to frictionally hold the lid to the perimeter side wall of the lid when the lid is resting on the annular shoulder of the perimeter side wall.

The bottom wall of the housing may have a spaced apart plurality of arcuate peripheral feet 21 downwardly extending therefrom along an outer perimeter of the bottom wall of the housing. The peripheral feet have lower edges 22 which may lie in a common plane substantially parallel to the bottom wall of the housing. In one embodiment, the plurality of peripheral feet comprising three peripheral feet.

The top edge of the perimeter side wall of the housing may have a spaced apart plurality of upwardly extending arcuate peripheral spacers therealong. The peripheral spacers have upper edges which may lie in a common plane substantially parallel to the bottom wall of the housing. In one embodiment, the plurality of peripheral spacers comprising three peripheral spacers.

The cooling insert is designed for use with a beverage container 25, particularly a wine bottle, and a wine bottle cooler container 26 which may have a generally cylindrical configuration and which includes a generally circular lower wall 27, a generally cylindrical perimeter wall 28 upwardly extending around the lower wall of the cooler container, and a generally circular open top.

As best illustrated in FIG. 2, in use, the cooling insert is inserted into the cooler container. The peripheral feet rest on the lower wall of the cooler container so that the lid and the peripheral spacers face upwards towards the open top of the cooler container. The beverage container is inserted into the cooler container such that the cooling insert is interposed between the lower wall of the cooler container and a bottom of the beverage container. The bottom of the beverage container is rested on the peripheral spacers so that the bottom of the beverage container is spaced above the top edge of the perimeter side wall of the housing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooling insert for insertion into a wine bottle cooler container for cooling a wine bottle beverage container inserted into the wine bottle cooler container, said cooling insert comprising:

a housing for holding a cooling material therein and comprising a bottom wall, a perimeter side wall upwardly extending around said bottom wall of said housing, and an open top defined by a top edge of said perimeter side wall of said housing;

a lid being inserted into said open top of said housing, said lid having a plurality of holes therethrough;

said perimeter side wall of said housing having an inner surface, said inner surface of said perimeter side wall having a shoulder therearound adjacent said top edge of said perimeter side wall of said housing;

said lid resting on said shoulder of said perimeter side wall;

said holes of said lid are generally triangular wedge-shaped and arranged on said lid to outwardly radiate from a center of said lid such that a generally circular extent is defined on said lid between said holes of said lid at said center of said lid; and said lid has an outer perimeter frictionally engaging said inner surface of said perimeter side wall to frictionally hold said lid to said perimeter side wall of said lid when said lid is resting on said annular shoulder of said perimeter side wall.

2. The cooling insert of claim 1, wherein said housing is generally cylindrical in shape and said lid is generally circular in shape.

3. The cooling insert of claim 1, further comprising a cooling material disposed in said housing, said lid being positioned above said cooling material.

4. The cooling insert of claim 1, wherein said bottom wall of said housing has a spaced apart plurality of arcuate peripheral feet downwardly extending therefrom along an outer perimeter of said bottom wall of said housing.

5. The cooling insert of claim 4, wherein said top edge of said perimeter side wall of said housing has a spaced apart plurality of upwardly extending arcuate peripheral spacers therealong.

6. A wine bottle cooling system, comprising:

a beverage container;

a cooler container having a generally cylindrical configuration and comprising a generally circular lower wall, a generally cylindrical perimeter wall upwardly extending around said lower wall of said cooler container, and a generally circular open top;

a cooling insert comprising:

a housing having a generally cylindrical configuration and comprising a generally circular bottom wall, a generally cylindrical perimeter side wall upwardly extending around said bottom wall of said housing, and an open top defined by a generally circular top edge of said perimeter side wall of said housing;

a cooling material being disposed in said housing;

a lid being generally circular in shape and having substantially planar top and bottom faces, and a generally circular outer perimeter;

said lid having a plurality of generally triangular wedge-shaped holes extending therethrough between said top and bottom faces of said lid;

said holes of said lid being arranged on said lid to outwardly radiating from a center of said lid such that a generally circular extent is defined on said lid between said holes of said lid at said center of said lid;

said lid being inserted into said open top of said housing to generally cover said cooling insert in said housing;

said perimeter side wall of said housing having an inner surface;

said inner surface of said perimeter side wall having an upwardly facing annular shoulder therearound adjacent said top edge of said perimeter side wall of said housing;

said annular shoulder of said perimeter side wall lying in plane substantially parallel to said bottom wall of said housing and positioned above said cooling insert in said housing;

said bottom face of said lid resting on said annular shoulder of said perimeter side wall such that said lid lies in a plane substantially parallel with said bottom wall of said housing;

said outer perimeter of said lid frictionally engaging said inner surface of said perimeter side wall to frictionally hold said lid to said perimeter side wall of said lid when said lid is resting on said annular shoulder of said perimeter side wall;

said bottom wall of said housing having a spaced apart plurality of arcuate peripheral feet downwardly extending therefrom along an outer perimeter of said bottom wall of said housing;

said peripheral feet having lower edges lying in a common plane substantially parallel to said bottom wall of said housing wherein said plurality of peripheral feet comprising three peripheral feet;

said top edge of said perimeter side wall of said housing having a spaced apart plurality of upwardly extending arcuate peripheral spacers therealong;

said peripheral spacers upper edges lying in a common plane substantially parallel to said bottom wall of said housing;

wherein said plurality of peripheral spacers comprising three peripheral spacers;

said cooling insert being inserted into said cooler container, said peripheral feet resting on said lower wall of said cooler container, said lid and said peripheral spacers facing upwardly towards said open top of said cooler container; and said beverage container being inserted into said cooler container such that said cooling insert is interposed between said lower wall of said cooler container and a bottom of said beverage container, said bottom of said beverage container resting on said peripheral spacers such that said bottom of said beverage container is spaced above said top edge of said perimeter side wall of said housing.

7. A cooling insert for insertion into a wine bottle cooler container for cooling a wine bottle beverage container inserted into the wine bottle cooler container, said cooling insert comprising:

a housing for holding a cooling material therein and comprising a bottom wall, a perimeter side wall upwardly extending around said bottom wall of said housing, and an open top defined by a top edge of said perimeter side wall of said housing;

a lid being inserted into said open top of said housing, said lid having a plurality of holes therethrough;

said perimeter side wall of said housing having an inner surface, said inner surface of said perimeter side wall having a shoulder therearound adjacent said top edge of said perimeter side wall of said housing;

said lid resting on said shoulder of said perimeter side wall; and wherein said top edge of said perimeter side wall of said housing has a spaced apart plurality of upwardly extending arcuate peripheral spacers therealong.

8. The cooling insert of claim 7, wherein said housing is generally cylindrical in shape and said lid is generally circular in shape.

9. The cooling insert of claim 7, further comprising a cooling material disposed in said housing, said lid being positioned above said cooling material.

10. The cooling insert of claim 7, wherein said bottom wall of said housing has a spaced apart plurality of arcuate peripheral feet downwardly extending therefrom along an outer perimeter of said bottom wall of said housing.

* * * * *